US010192700B2

(12) United States Patent
Rival et al.

(10) Patent No.: US 10,192,700 B2
(45) Date of Patent: Jan. 29, 2019

(54) AIR CIRCUIT BREAKER HAVING AN IMPROVED ELECTRIC ARC QUENCHING CHAMBER

(71) Applicant: Schneider Electric Industries SAS, Rueil Malmaison (FR)

(72) Inventors: Marc Rival, Saint-Ismier (FR); Michael Mary, St Martin-d'Heres (FR); Eric Pinero, Seyssinet-Pariset (FR); Brice Jacolin, Coublevie (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 0 days.

(21) Appl. No.: 15/474,226

(22) Filed: Mar. 30, 2017

(65) Prior Publication Data

US 2017/0309425 A1 Oct. 26, 2017

(30) Foreign Application Priority Data

Apr. 21, 2016 (FR) ..... 16 53554

(51) Int. Cl.
*H01H 33/10* (2006.01)
*H01H 33/62* (2006.01)
(Continued)

(52) U.S. Cl.
CPC ..... *H01H 33/10* (2013.01); *H01H 9/345* (2013.01); *H01H 9/346* (2013.01); *H01H 9/362* (2013.01); *H01H 33/62* (2013.01)

(58) Field of Classification Search
CPC ..... H01H 33/10; H01H 33/62; H01H 9/30; H01H 9/32; H01H 9/346; H01H 9/345; H01H 9/362
(Continued)

(56) References Cited

U.S. PATENT DOCUMENTS 5,210,385 A 5/1993 Morel et al.
5,589,672 A * 12/1996 Uchida ..... H01H 9/342 218/34
(Continued)

FOREIGN PATENT DOCUMENTS

EP 0 410 902 B1 2/1995
EP 1 020 882 A1 7/2000
WO WO 2007/113184 A1 10/2007

OTHER PUBLICATIONS

French Preliminary Search Report dated Dec. 5, 2016 in French Application 16 53554 filed on Apr. 21, 2016 (with English Translation of Categories of Cited Documents).

*Primary Examiner* — Edwin A. Leon
*Assistant Examiner* — William Bolton
(74) *Attorney, Agent, or Firm* — Oblon, McClelland, Maier & Neustadt, L.L.P.

(57) ABSTRACT

An air circuit breaker includes two separable electrical contacts connected to electric current input and output terminals; and a chamber for quenching an electric arc, including a stack of splitter plates that are spaced apart from one another, and lateral walls placed on either side of the stack and including a thermosetting-resin impregnated polyamide woven and being devoid of glass fibres. The quenching chamber furthermore includes protective elements made of crosslinked polyamide, the elements being placed in junction zones between the lateral walls and holding plates, the protective elements covering corners of the splitter plates, which corners are adjacent to the lateral walls, so as to separate these corners of the splitter plates from the electrical contacts.

13 Claims, 5 Drawing Sheets

(51) Int. Cl.
*H01H 9/34* (2006.01)
*H01H 9/36* (2006.01)
*H01H 33/65* (2009.01)

(58) Field of Classification Search
USPC ..... 218/151, 149, 150, 155
See application file for complete search history.

(56) References Cited

U.S. PATENT DOCUMENTS

| | | | | |
|---|---|---|---|---|
| 5,834,724 | A * | 11/1998 | Asakawa | H01H 9/36 218/36 |
| 6,218,636 | B1 | 4/2001 | Blancfene et al. | |
| 6,248,970 | B1 * | 6/2001 | DiMarco | H01H 9/34 218/149 |
| 9,082,571 | B2 * | 7/2015 | Seo | H01H 9/362 |
| 2001/0027961 | A1 * | 10/2001 | Brouillat | H01H 9/302 218/154 |
| 2006/0086693 | A1 | 4/2006 | Yeon | |
| 2008/0067042 | A1 * | 3/2008 | Shea | H01H 9/302 200/34 |
| 2009/0266794 | A1 | 10/2009 | Heydendorf et al. | |
| 2013/0284702 | A1 | 10/2013 | Hamada et al. | |

* cited by examiner

AIR CIRCUIT BREAKER HAVING AN IMPROVED ELECTRIC ARC QUENCHING CHAMBER

The present invention concerns a circuit breaker having an improved electric arc quenching chamber.

As is known, circuit breakers make it possible to interrupt the flow of an electric current within an electric circuit, such as a household or industrial distribution network. Typically, they comprise separable electrical contacts connected to the input and output terminals of an electric current. These electrical contacts are selectively displaceable between a closed position, in which they allow the electric current to flow between the terminals, and alternatively an open position in which they are spaced apart from one another so as to prevent the circulation of this electric current.

When these electrical contacts are moved into their open position when an electric current is present, an electric arc may be formed between these two electrical contacts. In the case of air type circuit breakers, this electric arc ionizes the ambient air present in the circuit breaker, which generates gases, known as quenching gases, said gases being then ejected to the outside of the circuit breaker. The electric arc is then extinguished by an arc quenching chamber of the circuit breaker, in order to interrupt the circulation of the electric current.

Such a quenching chamber comprises metallic splitter plates stacked horizontally at a spacing from one another, making it possible to split up the electric arc and absorb a portion of its energy, thus assisting in its extinguishing. These splitter plates are held in place by means of vertical walls, also called cheeks or flanges, which border the lateral edges of the quenching chamber. Typically, for circuit breakers of low voltage, that is, less than or equal to 1500 VAC or 1500 VDC, and high strength, that is, greater than or equal to 1 kA, these walls are made of a polyamide fabric impregnated with a thermosetting resin. Such a circuit breaker is known for example from document EP 1 020 882 A1.

The quenching chambers realized in this way, however, are not satisfactory when the quenching chamber is subjected repeatedly to electric arcs for currents with a strength less than 10 kA. In particular, in the case of currents with strength between 800 A and 4000 A and for electric voltage greater than 690 V AC, one finds that the electric arc formed during the opening of the contacts tends to remain for a prolonged period at the entrance to the quenching chamber, in the area of the junctions between the splitter plates and the vertical walls of the quenching chamber. By "prolonged duration" is meant for example a duration equal to or greater than 5 ms or equal to or greater than 10 ms after the opening of the contacts. This leads to an erosion of the lateral walls, resulting in a premature wear for the quenching chamber and thus compromising its proper functioning. In particular, a very substantial degradation of the lateral walls reduces the effectiveness of the arc quenching chamber and may result in a quenching failure of the circuit breaker. The reliability of the circuit breaker is thus reduced.

It is these drawbacks which the invention intends to remedy in particular, by proposing a circuit breaker having a quenching chamber for an electric arc with increased durability and better wear resistance when the circuit breaker is used for low voltage and electric currents of elevated strength.

Accordingly, the invention concerns an air circuit breaker including:

- two separable electrical contacts connected to electric current input and output terminals; and
- a chamber for quenching an electric arc, to extinguish an electric arc formed during the separation of the electrical contacts, this quenching chamber including a stack of splitter plates that are spaced apart from one another, and lateral walls placed on either side of the stack, the holding plates being fixed to the lateral walls, each lateral wall including a thermosetting-resin impregnated polyamide fabric and being devoid of glass fibres.

The quenching chamber furthermore includes protective elements made of crosslinked polyamide, said protective elements being placed inside the quenching chamber, along the lateral walls on either side of the stack, in junction zones between the lateral walls and the holding plates, the protective elements covering corners of the splitter plates which corners are adjacent to the lateral walls, so as to separate these corners of the splitter plates from the electrical contacts.

Thanks to the invention, the protective elements situated in the junction zones prevent the electric arc formed during the opening of the contacts from damaging the walls of the quenching chamber, especially when said electric arc is present for a prolonged time at the entrance of the quenching chamber. The lateral walls thus have improved durability and wear resistance. The reliability of the circuit breaker is thus enhanced.

According to advantageous but not mandatory aspects of the invention, such an electrical appliance may integrate one or more of the following characteristics, in any given technically feasible combination:

- Each protective element comprises seats bounded by fingers, one corner of a splitter plate of the stack being received inside each seat.
- Each protective element has a curved lateral surface extending, with a concave shape, from the lateral wall adjacent to the protective element to a central region of the stack.
- The distance between a zone of formation of electric arc between the electrical contacts and each protective element is greater than or equal to 5 mm, preferably greater than or equal to 7 mm, even more preferably between 12 mm and 15 mm.
- The protective elements of crosslinked polyamide each contain a mineral material with a concentration by weight less than or equal to 40%, the mineral material being other than glass fibres.
- The mineral material is wollastonite.
- The crosslinked polyamide material of the protective elements is polyamide 6,6.
- The protective elements extend substantially parallel to the stack, from a lower end of the stack to a lower edge of an upper arcing horn situated above the stack.
- The volume of material of the protective elements of the quenching chamber is less than or equal to 10 $cm^3$, preferably less than or equal to 5 $cm^3$.
- The protective elements are secured to the lateral walls by means of rivets.

The invention will be better understood and other of its benefits will become more clear in light of the following description of one embodiment of a circuit breaker given solely as an example and making reference to the appended drawings, in which:

FIG. 1 shows a circuit breaker 2 designed to be used in an electric circuit in order to enable the interruption of an electric power supply for this electric circuit, for example when a fault is detected, such as a short circuit or a power surge.

Figure 1:
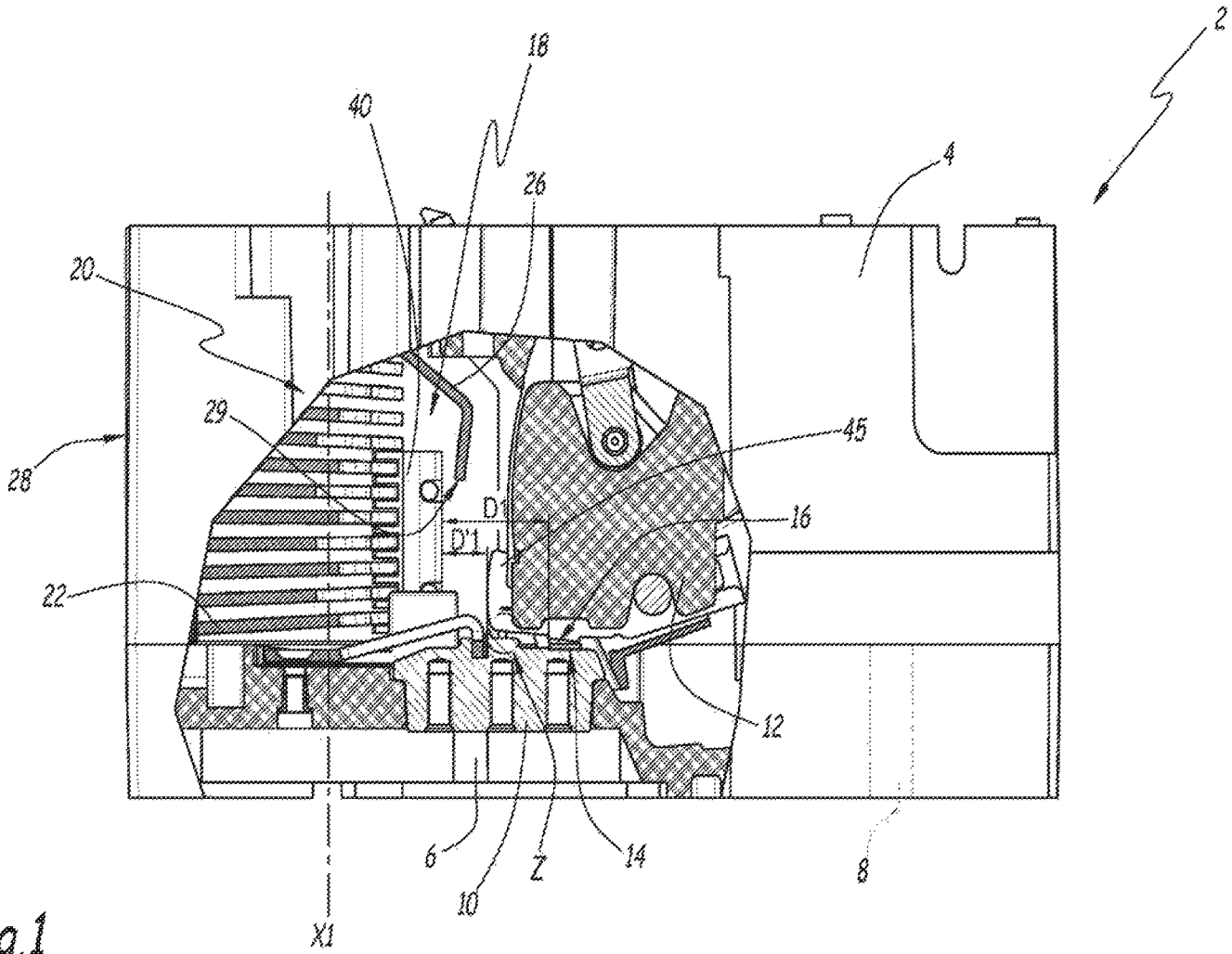
FIG. 1 is an illustration, in a longitudinal section view, of a portion of a circuit breaker comprising an electric arc quenching chamber according to the invention.
Figure 2:
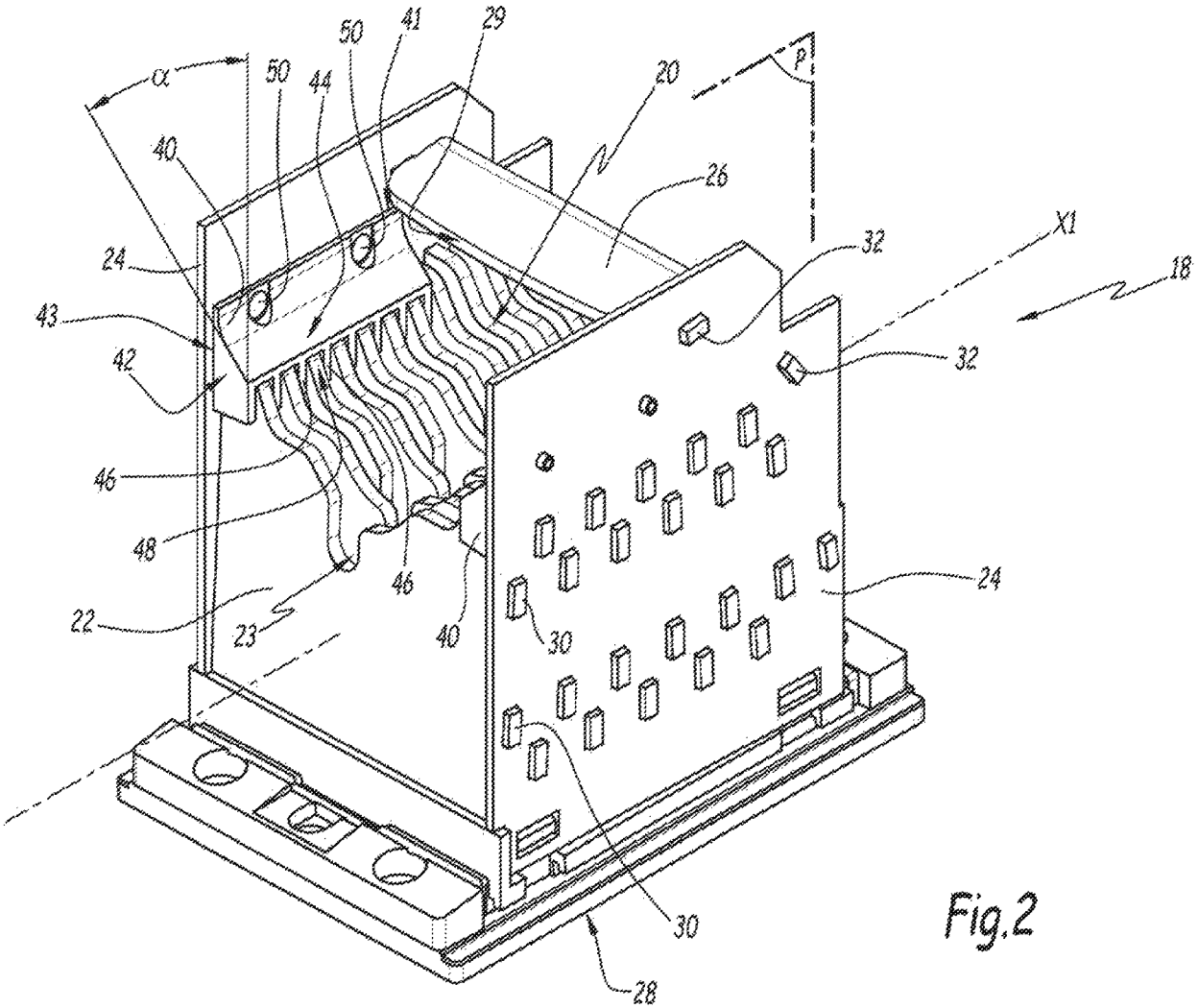
FIG. 2 is an illustration, in a perspective view, of an electric arc quenching chamber of the circuit breaker of FIG. 1.

In this example, the circuit breaker 2 is a low-voltage and alternating-current circuit breaker, designed for an electric voltage greater than or equal to 690 V AC and for electric currents with strength greater than 1 kA, for example those between 800 A and 4000 A. As a variant, the circuit breaker is designed for direct current.

The circuit breaker 2 comprises a housing 4 and input 6 and output 8 terminals for an electric current, partly illustrated, able to connect the circuit breaker 2 to the electric circuit, for example by means of sets of connection bars of an electrical panel. The terminals 6 and 8 are made of an electrically conductive material, such as copper.

The circuit breaker 2 likewise comprises separable electrical contacts 10 and 12, each of them provided with a contact pad, respectively 14 and 16, connected respectively to the input 6 and output 8 terminals. The contact pads 14 and 16 are made of an electrically conducting material, such as copper or a pseudo-silver alloy.

The electrical contacts 10 and 12 can move relative to one another, selectively and reversibly, between open and closed positions.

In the closed position, the contact pads 14 and 16 of the electrical contacts 10 and 12 are in direct contact with one another, thus allowing the flow of an electric current between the input terminals 6 and 8.

In the open position, the contact pads 14 and 16 are spaced apart from one another, for example by a distance greater than or equal to 5 mm or 10 mm. In the absence of an electric arc between the contact pads 14 and 16, the electric current is prevented from flowing between the terminals 6 and 8.

The circuit breaker 2 likewise comprises a movement mechanism, not illustrated, designed to move the separable electrical contacts 10 and 12 relative to each other between their open and closed positions, for example in response to the detection of an abnormal situation, such as an electric current surge. Such movement mechanisms are well known and shall not be further described in detail. Here, the electrical contact 10 is secured in relation to the housing 4 and only the electrical contact 12 is able to be moved by the movement mechanism.

When the electrical contacts 10 and 12 are separated from each other from their closed position to their open position, then if an electric current is flowing between the terminals 6 and 8 an electric arc may form between these electrical contacts 10 and 12. Such an electric arc allows the flowing of the current between the terminals 6 and 8 and it needs to be suppressed, that is extinguished, in order to interrupt the flow of the current. The interior of the housing 4 here is filled with air.

For this purpose, the circuit breaker 2 contains a quenching chamber 18 for an electric arc. The quenching chamber 18 is placed inside the housing 4, opposite the contact pads 14 and 16, so as to receive an electric arc during the formation of such.

FIGS. 2 to 5 illustrate in further detail an example of the quenching chamber 18. The quenching chamber 18 comprises a stack 20 of several splitter plates 22, lateral walls 24, and an upper arcing horn 26. By P is denoted a median geometrical plane of the quenching chamber 18.

The appearance of the electric arc between the contacts 14 and 16 ionizes and strongly heats the ambient air in the circuit breaker 2. The result is the formation of a gas, so-called quenching gas, which has an elevated temperature, typically above 5000° C. During the formation of an electric arc, this quenching gas is ejected outside of the quenching chamber 18, and thus outside of the housing 4, by means of a vent opening formed on a rear surface 28 of the quenching chamber 18. This vent opening is provided here with a filtration system for the quenching gases, not illustrated. Such a filtration system is well known and is not described in further detail. As an illustrative example, one uses the filtration system described in the application EP 1 020 882 A1.

In this description, the terms "front" and "rear" in relation to the quenching chamber 18 are defined in regard to the direction of normal flow of the quenching gases. Thus, the front portion of the quenching chamber 18 designates the portion of the quenching chamber 18 which is oriented toward the contacts 10 and 12, facing them. The rear portion of the quenching chamber 18 designates the portion of the quenching chamber 18 which is oriented toward the outside of the housing 4, opposite the front portion. The same goes for the elements of the quenching chamber 18, such as the splitter plates 22.

The splitter plates 22 are made of a metallic material and are designed to extinguish such an electric arc by breaking it up and/or partly absorbing its energy by melting or by vaporization of the metallic material when the electric arc enters into contact with these splitter plates 22. The splitter plates 22 each have a planar shape. The splitter plates 22 are stacked with a spacing from each other along a fixed axis X1 of the circuit breaker 2 and are spaced apart from each other along this axis X1. The axis X1 here is parallel to the median plane P. As an illustrative example, the stack 20 here comprises eleven splitter plates 22.

More precisely, in this example the splitter plates 22 extend substantially perpendicular to the axis X1, that is, perpendicular to the axis X1 except for less than 5°, preferably less than 3°. Thus, the splitter plates 22 are substantially parallel to each other, that is, parallel to each other except for less than 5°, preferably less than 3°. They converge in the direction of the front portion of the quenching chamber and move away from each other toward the rear of the quenching chamber 18. As a variant, the splitter plates 22 can be arranged parallel to each other and perpendicular to the axis X1.

Each of the splitter plates 22 is provided with a cavity 23, of rounded shape, which extends from the front edge of that splitter plate 22 to the centre of that splitter plate 22.

By D22 is denoted the thickness of a splitter plate 22, measured at the front edge of that plate. By E22 is denoted the spacing between two consecutive splitter plates 22, measured along the axis X1 between the facing surfaces of these two consecutive splitter plates 22. The thickness D22 for example is between 2 mm and 5 mm. As an illustration, the thickness D22 here is equal to 3.5 mm and the spacing E22 is equal to 4 mm.

The splitter plates 22 likewise comprise holding studs 30, which project at the lateral edges of said splitter plate 22, extending parallel to the plane of the splitter plate 22.

The lateral walls 24 have the function of ensuring that the stack 20 is held in place and that the quenching chamber 18 is bounded laterally. The lateral walls 24 here are of planar shape and extend parallel to themselves and parallel to the median plane P.

Each lateral wall 24 is formed by a structure of composite material, composed here of a polyamide fabric impregnated with a thermosetting resin. The polyamide here is polyamide 6,6, also known as "PA 6,6" or "polyhexamethylene adipamide". The lateral walls 24 are made for example by the method described in EP 1 020 882 A1.

The lateral walls 24 are devoid of glass fibres. By "devoid of glass fibres" is meant that the concentration of glass fibres inside each lateral wall 24, expressed as a percent by weight, is less than or equal to 0.05%, preferably less than or equal to 0.01%, even more preferably less than or equal to 0.001%. In the sense of the present description, glass micro-beads are considered to be glass fibres.

The presence of glass fibres or glass micro-beads inside the lateral walls 24 is not desirable. In fact, during the formation of an electric arc, on account of the elevated temperatures at play, typically above 700° C., the metals present inside the circuit breaker 2 are partially melted and/or vaporized upon the passing of the electric arc through them. For example, this is the case with the copper of the contact pads 14 and 16 or the metal of the splitter plates 22. This metal finds itself in suspension in the quenching gases and is redeposited on the outer surfaces of the glass fibres and, if present, the glass micro-beads, forming electrically conductive metallic masses locally. This decreases the electrical resistance of the surface of the lateral walls 24, and increases their risk of dielectric breakdown upon the further passage of an electric arc. This may give rise to a failure of the quenching of the circuit breaker 2 and is thus not acceptable.

The lateral walls 24 are secured to the splitter plates 22, in order to hold the stack 20 in place. For this, each lateral wall 24 is provided with notches, here, through notches, which receive the holding studs 30 so as to jointly secure the splitter plates 22. In similar manner, notches are devised on an upper portion of the lateral walls 24 in order to secure the arcing horn 26 there.

In this description, the terms "upper" and "lower" are defined in relation to the axis X1.

The lateral walls 24 here are in contact with the lateral edges of the splitter plates 22. By "junction zones" is meant regions of the quenching chamber 18 which are located at the junction between the lateral walls 24 on the one hand and the front edges of the splitter plates 22 on the other hand.

The purpose of the arcing horn 26 is to favour the movement of the electric arc from the contact pads 14 and 16 toward the inside of the quenching chamber 18. The arcing horn 26 is placed at a spacing above the stack 20, between the opposite lateral walls 24, in contact with these lateral walls 24. The arcing horn 26 has a portion folded toward the front of the quenching chamber 18 that extends in a direction substantially parallel with the axis X1, perpendicular to the axes of the splitter plates 22 which are situated in an upper part of the stack 20. This folded portion is intercalated here between the five splitter plates 22 from the top of the stack 20, on the one hand, and the electrical contacts 10 and 12 on the other hand. This folded portion is terminated by a lower edge 29.

The quenching chamber 18 furthermore comprises protective elements 40, secured inside the quenching chamber 18, in the area of the junction zones between the lateral walls 24 and the front edges of the splitter plates 22. The protective elements 40 are electrically insulating. The protective elements 40 have the function of protecting the junction zones between the splitter plates 22 and the lateral walls 24 in order to prevent the electric arc, when present inside the quenching chamber 18 between the splitter plates 22, from damaging the lateral walls 24 by erosion.

In this example, the quenching chamber 18 comprises two protective elements 40, which are identical to each other, each of them being secured to a lateral plate 24, symmetrically to each other in regard to the median plane P.

Each protective element 40 has the shape of a block extending longitudinally along the axis X1. The protective element 40 in particular has a front edge 41, a lower surface 42 and a first lateral surface 43 which is in contact with the lateral wall 24 on which the protective element 40 is secured.

The protective element 40 likewise comprises a second lateral surface 44, arranged opposite the first lateral surface 43. Advantageously, the second lateral surface 44 is curved and extends with a concave shape from the adjacent lateral wall 24, that is, the one to which the protective element 40 is secured here, to a central region of the stack 20. More precisely, the second lateral surface 44 extends from the front edge 41 and is turned toward the electrical contacts 10 and 12. By $\alpha$ is denoted an angle of inclination of the second lateral surface 44, this angle $\alpha$ being measured outside of the protective element 40, opposite the front edge 41, between the ridge of the protective element 40 which is common to the surfaces 42 and 44, on the one hand, and an axis perpendicular to the axis X1 and parallel to the median plane P, on the other hand. The angle $\alpha$ is between 30° and 60°, preferably between 40° and 50°, even more preferably equal to 45°.

The concave shape of the second lateral surface 44 plays a guiding role for the electric arc toward the central region of the quenching chamber, away from the lateral walls 24. In this way, the electric arc is moved away from the lateral walls 24. The risk of wear on the lateral walls 24 by erosion is thus reduced.

By D40 and D40' are denoted the thicknesses of the lower surface 42, respectively measured in the area of the front edge 41 and the opposite edge of the lower surface 42. These thicknesses are measured perpendicular to the median plane P. As an illustration, the thickness D40 is equal to 1.5 mm and the thickness D40' is equal to 7 mm.

The protective elements 40 are arranged at a distance from a zone Z of formation of the electric arc. The zone Z of arc formation designates here the space volume in which the electric arc originates upon movement of the electrical contacts 10 and 12 to the open position.

In this example, the zone Z of arc formation is located between the electrical contact 10 and one end of a movable portion 45 of the electrical contact 12 which is electrically connected to the contact pad 16. The movable portion 45 is designed to pivot in relation to the electrical contact 12 when the electrical contacts 10 and 12 are moved away from each other into the open position. In doing so, the end of the movable portion 45 first of all makes contact with the electrical contact 10, and then only moves away from it when the contact pads 14 and 16 are separated from each other. The electric arc then forms between this end of the movable portion 45 and the electrical contact 10. This prevents the electric arc from forming between the contact pads 14 and 16, since this might damage them. The movable portion 45 is described, for example, in the patent EP 0410902 B1.

Preferably, the contact pads 14 and 16 do not penetrate inside the quenching chamber 18. The zone Z of arc formation here is situated outside of the quenching chamber 18.

By D1 is denoted the smallest distance between the closest edges of the contact pads 14 and/or 16 on the one hand and the elements 40 on the other hand. By D'1 is denoted the smallest distance between the closest contact edges 12 of the protective elements 40, here the ends of the movable part 45, on the one hand, and the protective elements 40 on the other hand. Here, the distances D1 and D'1 are measured in the median plane P, for example, by orthogonal projection in this median plane P.

Taking into account the permitted travel for the contact 12 between the open and closed positions, this distance D1 is measured here in relation to the contact pads 14 and 16 in the closed position of the contacts 10 and 12. Here, taking into account the arrangement of the protective elements 40, the distances D1 and D'1 are furthermore measured in relation to the respective front edges 41 of the protective elements 40.

Thus, the distance D'1 corresponds here to a distance between the front edges 41 of the protective elements 40 and the zone Z of arc formation between the electrical contacts 10 and 12.

The distance D1 here is greater than or equal to 10 mm or 20 mm.

The distance D'1 is greater than or equal to 5 mm, preferably greater than or equal to 7 mm. This distance D'1 is less than or equal to 30 mm. In particularly preferred manner, the distance D'1 is greater than or equal to 12 mm and less than or equal to 15 mm.

This arrangement of the protective elements 40 at a distance from the zone of arc formation allows them to better resist the temperature rise during the formation of an electric arc by moving them away from the zones where the temperature is the most elevated. The risk of destruction of the protective elements 40 during the separation of the contacts 10 and 12 is thus reduced.

Each protective element 40 is made of polyamide, for example, polyamide 6,6. The protective element 40 here is devoid of glass fibres. This polyamide is crosslinked, which gives it better strength when exposed to elevated temperatures, typically higher than 700° C., in transitory fashion. For example, the protective element 40 is made by moulding, and then it undergoes a cross-linking operation afterwards.

Advantageously, the polyamide forming the protective element 40 is reinforced with a ballast of a mineral material. Thus, each protective element 40 comprises a mineral material, with a concentration, expressed in percent by weight, less than or equal to 40%. This mineral material is different from glass fibres, that is, it is not constituted by glass fibres. In this embodiment, the mineral material is a silicate material, belonging for example to the family of the inosilicates. Preferably, this mineral material is wollastonite.

Thanks to this mineral material, the durability of the protective element 40 is strengthened, which is advantageous for certain applications in which the circuit breaker 2 is intended to be subjected to an elevated number of cycles of opening and closing during its service life, for example, more than 10000 cycles. This is the case, for example, when the circuit breaker 2 is used together with wind turbines.

As a variant, the reinforcement of the element mineral material is omitted.

Preferably, the elements 40 do not extend for the entire height of the lateral walls 24. For example, the protective element 40 extends along the axis X1 from the lower splitter plate 22 of the stack 20 as far as the splitter plate 22 of the stack 20 which is situated immediately above the lower edge 29 of the arcing horn 26.

For example, the volume of material of the protective elements 40 is less than or equal to 10 $cm^3$, preferably less than or equal to 5 $cm^3$.

The particular shape and the dimensions of each protective element 40 make it possible to achieve a satisfactory protection of the lateral walls 24 in the area of the junction zones, while limiting the quantity of gas liable to be emitted during the passing of the electric arc, due to the melting and/or partial vaporization of the protective element 40. This effect is achieved in particular by reducing the quantity of material used to form the elements 40 and by limiting the height of each protective element 40.

In fact, the polyamide used to form the elements 40 is gasogenic, that is, it gives off gas when it is heated during the passage of the electric arc and/or the quenching gas in the quenching chamber 18. In the present case, this outgassing should be limited as much as possible, since on the one hand it causes an excess pressure which may damage the housing 4 and on the other hand it increases the content of pollutants in the quenching gas, requiring the installation of a more effective pollution control system at the outlet from the quenching chamber 18.

In particularly advantageous manner, each protective element 40 comprises fingers 46, or ribs, which delimit seats 48 inside the protective element 40. In a mounted configuration of this protective element 40, each seat 48 receives a front corner 49 of a splitter plate 22 of the stack 20 within this seat 48. The corner 49 is adjacent to the lateral wall 24 and is placed in front of the splitter plate 22. This splitter plate 22 is then said to be engaging with the protective element 40. The fingers 46 then separate, two by two, the splitter plates 22 engaging with the protective element 40.

Figure 3:
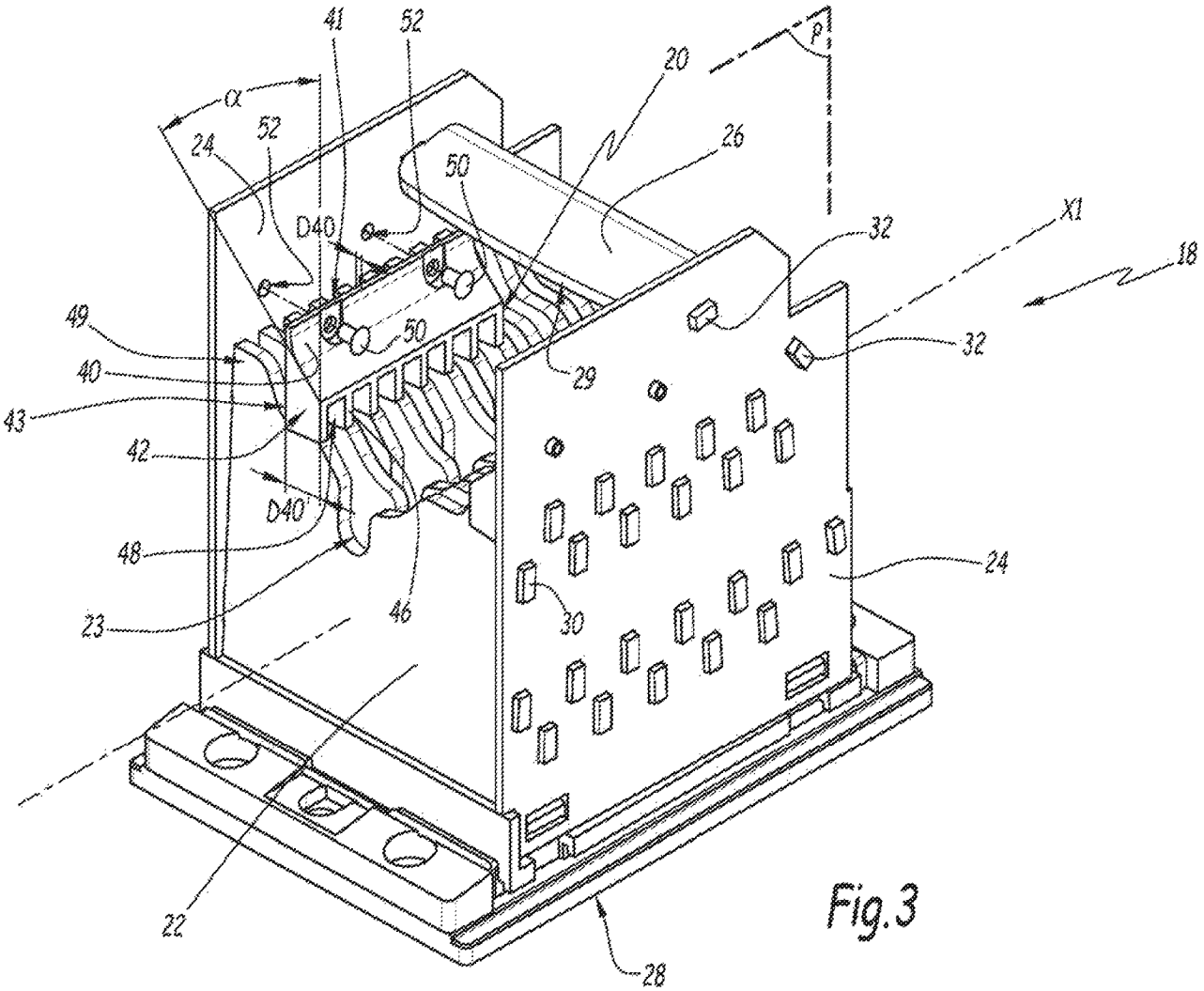
FIG. 3 is an illustration, in a partially exploded perspective view, of the electric arc quenching chamber of FIG. 2.
Figure 4:
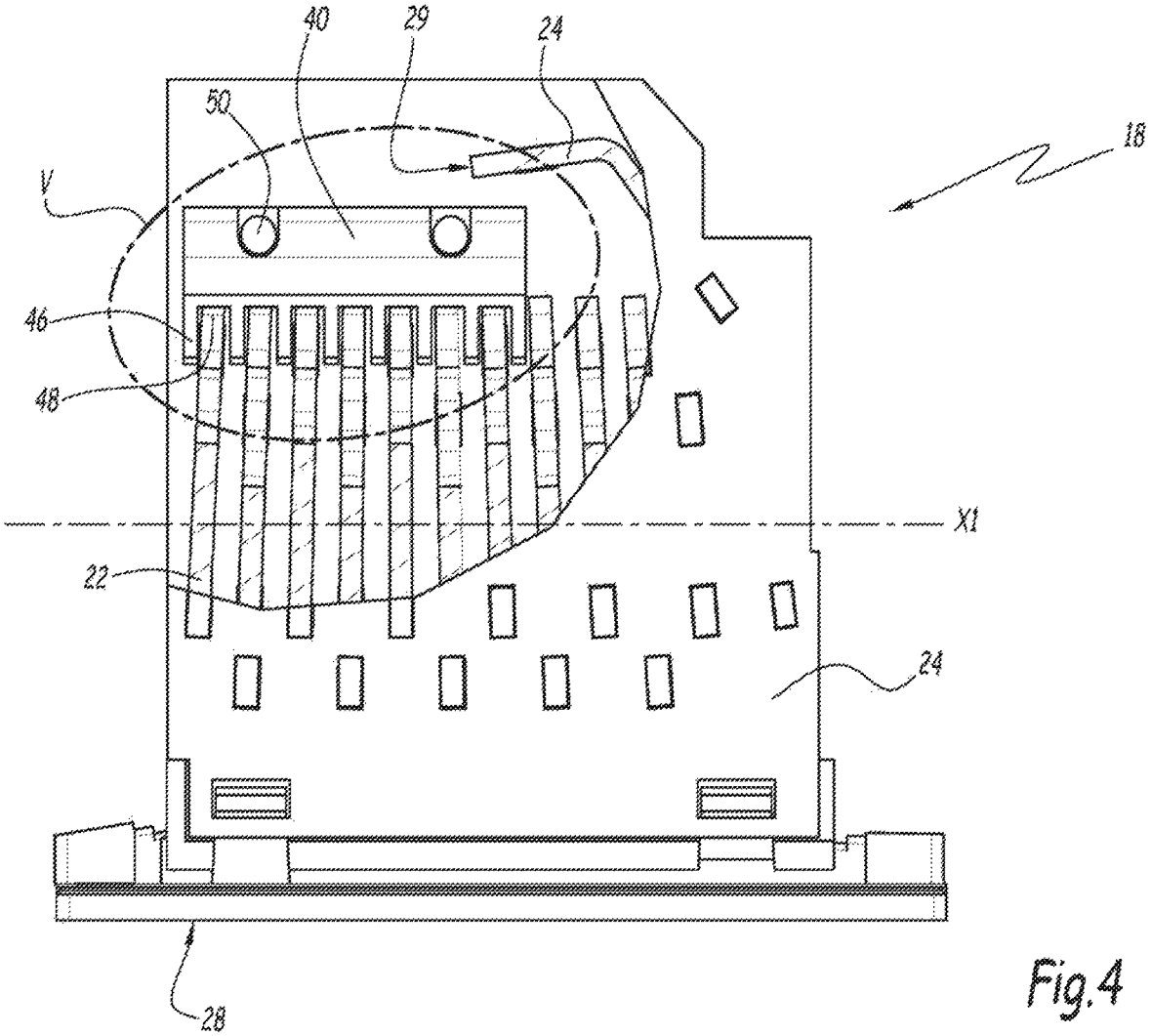
FIG. 4 is a partial cut-away illustration of the electric arc quenching chamber of FIGS. 2 and 3, in a side view in a median plane of this electric arc quenching chamber.

Each splitter plate 22 comprises two front corners 49. However, a single front corner 49 is illustrated in FIG. 3, for reasons of clarity. On account of the arrangement of the protective elements 40, each splitter plate 22 which is engaged in one of the protective elements 40 in the area of one of its front corners 49 is likewise engaged in the opposite protective element 40 in the area of its other front corner 49.

In this example, the fingers 46 have the shape of a plane and rectilinear plate and they form upper and lower surfaces of the seats 48. The seats 48 have the shape of a pavement with a rectangular base and they emerge on the outside of the protective element 40, laterally and to the rear of this protective element 40. The fingers 46 are identical to each other. Likewise, the seats 48 are identical to each other. For example, the seats 48 are formed by recessing a rear portion of this protective element 40. The fingers 46 extend projecting to the rear of the protective element 40 perpendicular to this protective element 40, in the manner of the fingers of a comb. In this example, each protective element 40 comprises seven seats 48, bounded by eight fingers 46.

Figure 5:
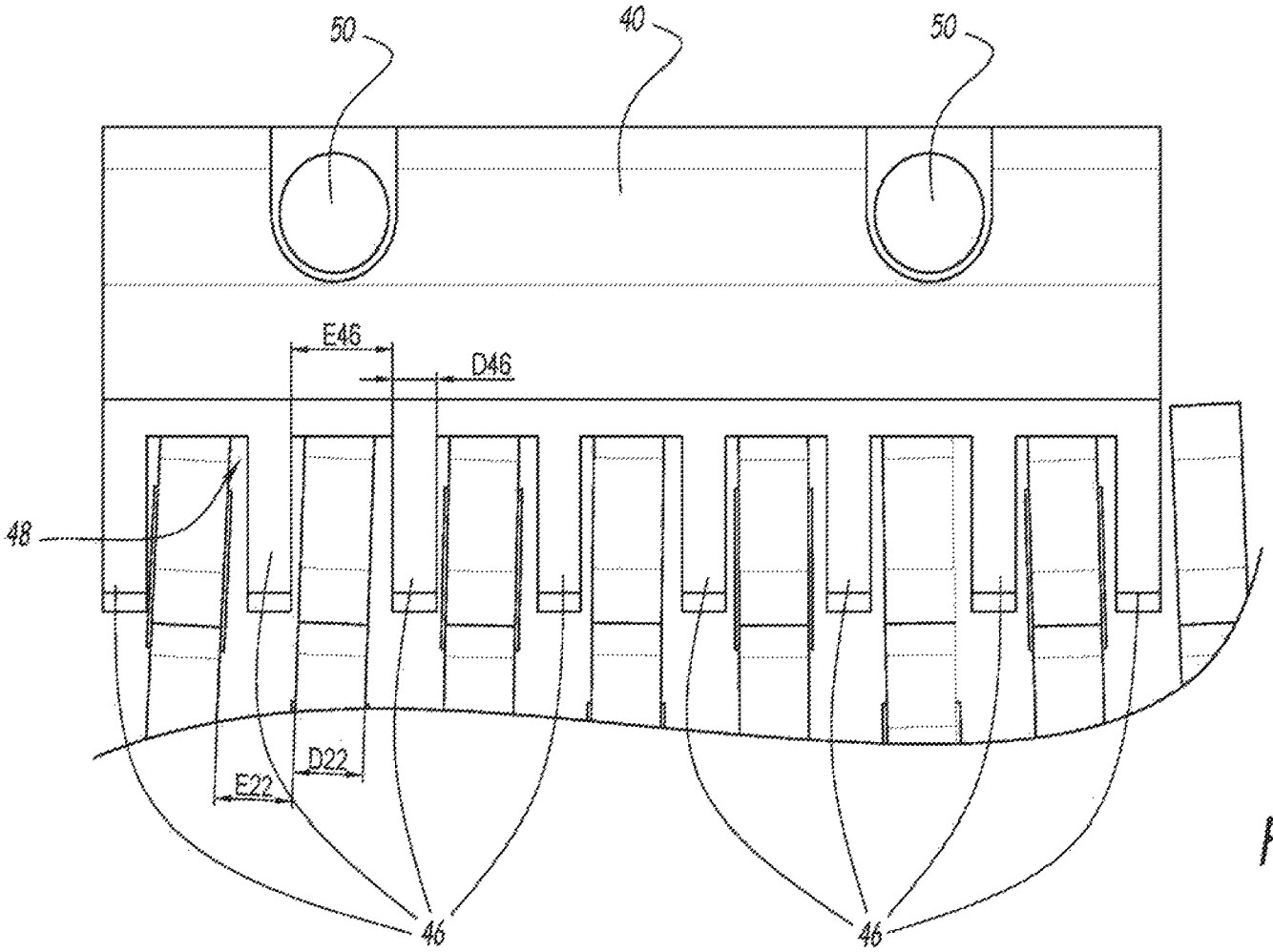
FIG. 5 is a close-up view of zone V of FIG. 4.

As illustrated in FIG. 5, D46 denotes the thickness of a finger 46 and E46 denotes the space between the adjacent surfaces of two contiguous fingers 46, this thickness D46 and this spacing E46 being measured along the axis X1. Preferably, the dimensions of the seats 48, and in particular the spacing E46, are chosen according to the thickness D22 of the splitter plates 22, to allow the least possible play between the fingers 46 and the corners 49. Preferably, the corners 49 received inside the seats 48 are sunken as far as the bottom of these seats 48. As an illustration, the thickness D46 is equal to 3 mm and the spacing E46 is equal to 4 mm.

Each of the splitter plates 22 engaging with the protective element 40 is thus covered, on its upper and lower surfaces, by the fingers 46 in the area of its corner 49.

This prevents the quenching gas circulating in the quenching chamber 18 from circulating near the junction zones. In fact, the quenching gas contains metallic particles in suspension, which are electrically conductive. When the plates 22 are engaged in the protective elements 40, the quenching gas is prevented from recirculating between the splitter plates 22 to the front of the quenching chamber 18. Such a recirculation needs to be avoided, since it might cause an unwanted loopback of the electric current and prevent the breaking of the current. On the other hand, the metallic particles contained in the quenching gas are liable to be deposited by condensation on the lateral walls 24, in the area of the junction zones. This should also be avoided, since such a deposit would favour short circuits inside the quenching chamber 18. This deposit on the lateral walls 24 is prevented here thanks to the finger and comb structure formed by the alternation of fingers 46 and seats 48.

The effectiveness of the protective elements 40 is thus significantly improved.

Moreover, each of the splitter plates 22 engaging with the protective element 40 is likewise covered at its front edge, in the area of this same corner 49, by the second lateral surface 44 of the protective element 40. Thus, the corner 49 of the splitter plate 22 is separated from the contact pads 10 and 12 and thus is not directly exposed to the zone of formation of the electric arc. The electric arc therefore cannot come near the lateral walls 24. The effectiveness of the protective elements 40 is increased, and the lateral walls 24 are better protected.

In fact, the splitter plates 22 which are received in the seats 48 are the ones which extend beneath the lower edge 29 of the upper arcing horn 26, and thus the ones which are most exposed to the electric arc. Thus, it is in the area of the junction of these splitter plates 22 with the lateral walls 24 where an electric arc is most likely to dwell and cause erosion damage to the lateral wall 24.

Thanks to the protective elements 40, when the electric arc penetrates into the quenching chamber 18 and enters into contact with the splitter plates 22, it cannot come close to the corners 49 of these splitter plates 22 which are covered by these protective elements 40, since these protective elements 40 are electrically insulating and sufficiently strong in their structure not to be destroyed by the electric arc. Thus, the erosion of the lateral walls 24 is limited, especially under operating conditions of the circuit breaker 2 for which the quenching chamber 18 is repeatedly subjected to electric arcs for currents less than 10 kA in strength.

The protective elements 40 are secured to the lateral walls 24. More precisely, each protective element 40 is secured, firmly and with no freedom of movement, to a lateral wall 24 by means of fixation elements. Here, the fixation elements are rivets 50, which are mounted in corresponding holes 52 of the lateral wall 24. The rivets 50 make it possible to secure the protective elements 40 with a satisfactory robustness.

As a variant, the protective elements 40 are secured here to the lateral walls 24 in a different way, for example, by snapping in. In this case, the rivets 50 and the holes 52 are omitted. The fixation elements then comprise deformable parts, of complementary shape, arranged on the protective elements 40 and on the lateral walls 24.

The embodiments and the variants considered above can be combined among themselves to create new embodiments.

The invention claimed is:

1. An air circuit breaker, comprising:

two separable electrical contacts connected to electric current input and output terminals; and a chamber for quenching an electric arc, to extinguish the electric arc formed during the separation of the electrical contacts, said quenching chamber comprising a stack of splitter plates that are spaced apart from one another, and lateral walls placed on either side of the stack, the splitter plates being fixed to the lateral walls, each lateral wall including a thermosetting-resin impregnated polyamide fabric and being devoid of glass fibres, wherein the quenching chamber furthermore includes protective elements made of crosslinked polyamide, said protective elements being placed inside the quenching chamber, along the lateral walls on either side of the stack, in junction zones between the lateral walls and the splitter plates, the protective elements covering corners of the splitter plates which corners are adjacent to the lateral walls, so as to separate these corners of the splitter plates from the electrical contacts, and wherein each protective element comprises seats and a plurality of fingers, the seats being bounded by the fingers, one corner of the splitter plate of the stack being received inside each seat, and each pair of fingers in the plurality of fingers having one of the splitter plates disposed therebetween, wherein the protective elements extend substantially parallel to the stack, from a lower end of the stack to a lower edge of an upper arcing horn situated above the stack, such that are there splitter plates included in the stack of splitter plates which are not covered by the protective elements.

2. The circuit breaker according to claim 1, wherein each protective element has a curved lateral surface extending, with a concave shape, from the lateral wall adjacent to the protective element to a central region of the stack.

3. The circuit breaker according to claim 1, wherein a distance between a zone of formation of electric arc between the electrical contacts and each protective element is greater than or equal to 5 mm.

4. The circuit breaker according to claim 1, wherein the protective elements of crosslinked polyamide each contain a mineral material with a concentration by weight less than or equal to 40%, the mineral material being other than glass fibres.

5. The circuit breaker according to claim 4, wherein the mineral material is wollastonite.

6. The circuit breaker according to claim 1, wherein the crosslinked polyamide material of the protective elements is polyamide 6,6.

7. The circuit breaker according to claim 1, wherein a volume of material of the protective elements of the quenching chamber is less than or equal to 10 $cm^3$.

8. The circuit breaker according to claim 1, wherein the protective elements are secured to the lateral walls by rivets.

9. The circuit breaker according to claim 1, wherein a distance between a zone of formation of electric arc between the electrical contacts and each protective element is greater than or equal to 7 mm.

10. The circuit breaker according to claim 1, wherein a distance between a zone of formation of electric arc between the electrical contacts and each protective element is between 12 mm and 15 mm.

11. The circuit breaker according to claim 1, wherein a volume of material of the protective elements of the quenching chamber is less than or equal to 5 $cm^3$.

12. An air circuit breaker, comprising:

two separable electrical contacts connected to electric current input and output terminals; and a chamber for quenching an electric arc, to extinguish the electric arc formed during the separation of the electrical contacts, said quenching chamber comprising a stack of splitter plates that are spaced apart from one another, and lateral walls placed on either side of the stack, the splitter plates being fixed to the lateral walls, each lateral wall including a thermosetting-resin impregnated polyamide fabric and being devoid of glass fibres, wherein the quenching chamber furthermore includes protective elements made of crosslinked polyamide, said protective elements being placed inside the quenching chamber, along the lateral walls on either side of the stack, in junction zones between the lateral walls and the splitter plates, the protective elements covering corners of the splitter plates which corners are adjacent to the lateral walls, so as to separate these corners of the splitter plates from the electrical contacts, and wherein each protective element has a curved lateral surface extending, with a concave shape, from the lateral wall adjacent to the protective element to a central region of the stack.

13. An air circuit breaker, comprising:

two separable electrical contacts connected to electric current input and output terminals; and a chamber for quenching an electric arc, to extinguish the electric arc formed during the separation of the electrical contacts, said quenching chamber comprising a stack of splitter plates that are spaced apart from one another, and lateral walls placed on either side of the stack, the splitter plates being fixed to the lateral walls, each lateral wall including a thermosetting-resin impregnated polyamide fabric and being devoid of glass fibres, wherein the quenching chamber furthermore includes protective elements made of crosslinked polyamide, said protective elements being placed inside the quenching chamber, along the lateral walls on either side of the stack, in junction zones between the lateral walls and the splitter plates, the protective elements covering corners of the splitter plates which corners are adjacent to the lateral walls, so as to separate these corners of the splitter plates from the electrical contacts, and wherein the protective elements of crosslinked polyamide each contain a mineral material with a concentration by weight less than or equal to 40%, the mineral material being other than glass fibres.

* * * * *